US006850622B2

(12) United States Patent
Maejima

(10) Patent No.: US 6,850,622 B2
(45) Date of Patent: Feb. 1, 2005

(54) SOUND FIELD CORRECTION CIRCUIT

(75) Inventor: Yoshimichi Maejima, Kanagawa (JP)

(73) Assignee: Sony Corporation, Tokyo (JP)

( * ) Notice: Subject to any disclaimer, the term of this patent is extended or adjusted under 35 U.S.C. 154(b) by 304 days.

(21) Appl. No.: 09/919,210

(22) Filed: Jul. 30, 2001

(65) Prior Publication Data

US 2003/0076972 A1 Apr. 24, 2003

Related U.S. Application Data

(62) Division of application No. 09/081,370, filed on May 19, 1998.

(30) Foreign Application Priority Data

May 29, 1997 (JP) ..... 9-140188

(51) Int. Cl.[7] ..... H04R 5/00
(52) U.S. Cl. ..... 381/22
(58) Field of Search ..... 381/22, 20, 17, 381/18, 19, 23, 21, 104, 107, 108, 307

(56) References Cited

U.S. PATENT DOCUMENTS

| | | | | |
|---|---|---|---|---|
| 3,783,192 A | | 1/1974 | Takahashi | |
| 3,836,715 A | | 9/1974 | Ito et al. | |
| 3,934,086 A | | 1/1976 | Takahashi | |
| 4,021,612 A | | 5/1977 | Takahashi | |
| 4,159,397 A | * | 6/1979 | Iwahara et al. | 381/19 |
| 4,748,669 A | | 5/1988 | Klayman | |
| 4,850,021 A | | 7/1989 | Sparkjaer | |
| 4,933,768 A | | 6/1990 | Ishikawa et al. | |
| 5,261,005 A | | 11/1993 | Masayuki | |
| 5,291,557 A | | 3/1994 | Davis et al. | |
| 5,638,452 A | | 6/1997 | Waller, Jr. | |
| 5,727,068 A | * | 3/1998 | Karagosian et al. | 381/22 |
| 5,862,228 A | | 1/1999 | Davis | |
| 5,872,851 A | | 2/1999 | Petroff | |

* cited by examiner

*Primary Examiner*—Minsun Oh Harvey
*Assistant Examiner*—Brian Pendleton
(74) *Attorney, Agent, or Firm*—Frommer Lawrence & Haug LLP; William S. Frommer; Darren M. Simon

(57) ABSTRACT

The invention provides a sound field correction circuit for a surround playback apparatus wherein a decoding circuit is formed from a comparatively simple circuit and similar effects to those of a ordinary sound field correction circuit can be achieved at a reduced cost. A sound field correction circuit includes a decoding circuit for restoring 2-channel stereo signals encoded for a multi-channel surround effect to obtain multi-channel surround signals. The decoding circuit includes an adder for adding the encoded 2-channel stereo signals to each other, a subtractor for subtracting one of the encoded 2-chhanel stereo signals from the other, a level adjusting volume for adjusting the output level of the adder, and another level adjusting volume for adjusting the output level of the subtractor. An output of the level adjusting volume is used as a center channel signal while an output of the level adjusting volume 6 is used as a surround channel signal.

2 Claims, 3 Drawing Sheets

SOUND FIELD CORRECTION CIRCUIT

This application is a divisional of U.S. application Ser. No. 09/081,370, filed May 19, 1998.

BACKGROUND OF THE INVENTION

1. Field of the Invention

This invention relates to a sound field correction circuit for a surround acoustic system, and more particularly to simplification of a decoding circuit for obtaining multi-channel surround signals from 2-channel stereo signals encoded for a multi-channel surround effect.

2. Description of the Related Art

It is known that a human being orients low-pitched sound sources based on a time difference and/or phase difference between sounds arriving at each ear, but orients high-pitched sound sources based on the strength difference between incoming sounds to each ear.

Also, it is known that a person's sense of hearing blends sounds from a plurality of sound sources to form a single sound image. In this instance, the sounds are more likely to be blended when the signals are coherent and the arrival times of the signals are limited to a certain range. The orientation of a composite sound image, when two coherent sound sources are involved, depends upon the amplitude difference or the time difference between the sound source signals. A composite sound image from coherent sound sources appears to be substantially oriented between the two sound sources. However, when the sound sources have opposite phases, the sound image produced appears to be sourced within the listener's head. When in addition to the direct sound from a sound source, there are a large number of succeeding sounds, such as reflected sounds from the walls and floor, conveyed to the listener the expansiveness of the sound or the distance of the sound source appears to increase. Particularly, when sound reflected from the side becomes large in comparison to the direct sound, then the extensiveness of the sound image increases.

An available system, wherein the feeling of movement is emphasized using a rear speaker or the like in order to improve the presence of the played back sound, that makes use of the above-described effect is a surround system. A surround system generally is an acoustic system having, in addition to left and right speakers for providing an original stereo effect, a sub-speaker placed at a different position.

While a surround system is similar to a 4-channel stereo system, in that an additional speaker is used in addition to the left and right speakers, it is quite different. The contents of the signal recorded on an original source, such as a record or a video tape, are not special as is the case for a 4-channel stereo system. Surround system signals may be the same signals as recorded for an ordinary stereo system. In other words, the surround system does not require a specially recorded signal. The only signal criteria is the satisfaction of the listener.

Therefore, what is significant is the purpose of the person trying to enjoy the sound. Such purposes can be divided into the following two types:

1) Reproduction of an audio signal of a video tape. The purpose is a theater effect wherein played-back sound is made to realistically conform to an image; and
2) When the relationship to a picture is not taken into consideration. The purpose is to conscientiously reproduce the sound field at a site, such as a hall where the music was recorded.

The problem is how to produce the sound so that either purpose, as described above, can be achieved. In the case of purpose 1 above, when the sound depends upon the scene, reproduction of the position of a sound source or of the feeling of movement is needed. In the case of purpose 2, where the sound source does not move and it is desired to conscientiously reproduce the acoustic conditions of the place where the sound was recorded, the length or the magnitude of reverberation and the frequency components included in the reverberation are important.

For example, in purpose 1 above, if it is assumed that the video includes a scene in which it thunders, then it is more realistic if the thunder sounds from above. To achieve this effect, greater importance needs to be attached to the position or the distance to a sound source or the feeling of movement. Reproduction from such a point of view, as described above, is basically impossible with stereo signals recorded by an ordinary method. A source where the sound was collected upon recording using some suitable discretion is more advantageous.

A representative surround system, as described above, is the Dolby pro-logic surround system. The Dolby pro-logic surround system is a modification of the Dolby surround system, which originally was an acoustic system for a movie theater, in that it employs three front channels (L: Left, C: Center, R: Right) and one rear channel (S: Surround) to make an acoustic system for enjoying a movie.

In such a multi-channel surround system as just described, multi-channel signals are normally encoded and recorded in 2 channels on a recording medium. Then, on playback, the 2-channel signals from the recording medium are decoded into multi-channels to produce multi-channel surround signals. Further, when the thus decoded multi-channel surround signals are played back into the front 2-channel surround signals of an ordinary stereo apparatus the multi-channel surround signals are converted into 2-channels by a circuit called a virtualizer.

A sound field correction circuit which first converts 2-channel audio signals into multi-channel surround signals and then into front 2-channel surround signals is shown in FIG. 1. Stereo signals Lt, Rt encoded for a multi-channel surround effect are first sent to a decoder 1. Then, the stereo signals Lt, Rt are converted from 2-channel signals back into multi-channel signals (for example, L: left channel signal, C: center channel signal, R: right channel signal, S: surround channel signal) in the decoder 1. The resulting multi-channel signals are sent to a virtualizer circuit 2. The virtualizer circuit 2 is a circuit which processes an audio signal so that the sound appears to be coming from around or from in back of the listener, as if a surround component S were actually present.

In the ordinary sound field correction circuit described above, decoding of signals from a 2-channel source into multi-channel signals is realized by performing complicated matrix processing using a decoding circuit called a surround processor. The decoding circuit is a combination of a plurality of delay circuits or phase shifters and produces a sum signal and/or a difference signal between an original signal and a signal obtained by performing a delaying process or a phase shifting process. This process enriches the extensiveness of the sound, the distance feeling for the sound image, the feeling of movement of the sound image, and so forth. Because the decoding circuit performs such complicated processes, when an ordinary decoding circuit is employed the decoding circuit significantly increases the size and the cost for the entire apparatus.

Therefore, in the ordinary sound field correction circuit for playback of surround signals as described above, when a complicated matrix process is performed by a circuit for decoding a drawback is that the circuit becomes large and consequently the apparatus becomes expensive.

SUMMARY OF THE INVENTION

It is an object of the present invention to provide a sound field correction circuit for a surround playback apparatus wherein a decoding circuit is constructed using a comparatively simple circuit and effects equivalent to those of an ordinary sound field correction circuit, as described above, can be achieved at a low cost.

In order to attain the object described above, the present invention provides a sound field correction circuit which receives signals of at least 2 channels encoded for a multi-channel surround effect as input signals and outputs multi-channel surround signals. An inputting means receives at least a first signal and a second signal encoded for a multi-channel surround effect as input signals. A decoding means decodes the first and second signals to produce multi-channel surround signals. The decoding means includes addition means for adding the first and second signals to produce a sum signal, and subtraction means for subtracting the second signal from the first signal to produce a difference signal.

The decoding means may further include sum signal level adjustment means for receiving the sum signal, adjusting a level of the sum signal and outputting the sum signal having the adjusted level; and difference signal level adjustment means for receiving the difference signal, adjusting a level of the difference signal and outputting the adjusted difference signal.

In the sound field correction circuit, the decoding circuit for restoring first and second signals such as 2-channel stereo signals encoded for a multi-channel surround effect is formed from the addition means and the subtraction means to which the first and second signals are input, and the sum signal level adjustment means and the difference signal level adjustment means for adjusting the output levels of the addition means and the subtraction means.

Consequently, with the sound field correction circuit, a practical surround effect can be realized at a very low cost. Further, the sound field correction circuit can be utilized advantageously in, for example, TVs, video tape recorders, and portable low-priced acoustic apparatus which do not require a very high sound quality.

Furthermore, where noise reduction of the Dolby B type is performed on the difference signal from the subtraction means, noise in the playback stage can be reduced significantly and a surround playback signal which is easy to listen to and is full of presence is obtained.

The above and other objects, features and advantages of the present invention will become apparent from the following description and the appended claims, taken in conjunction with the accompanying drawings in which like parts or elements are denoted by like reference symbols.

DESCRIPTION OF THE PREFERRED EMBODIMENTS

Figure 2:
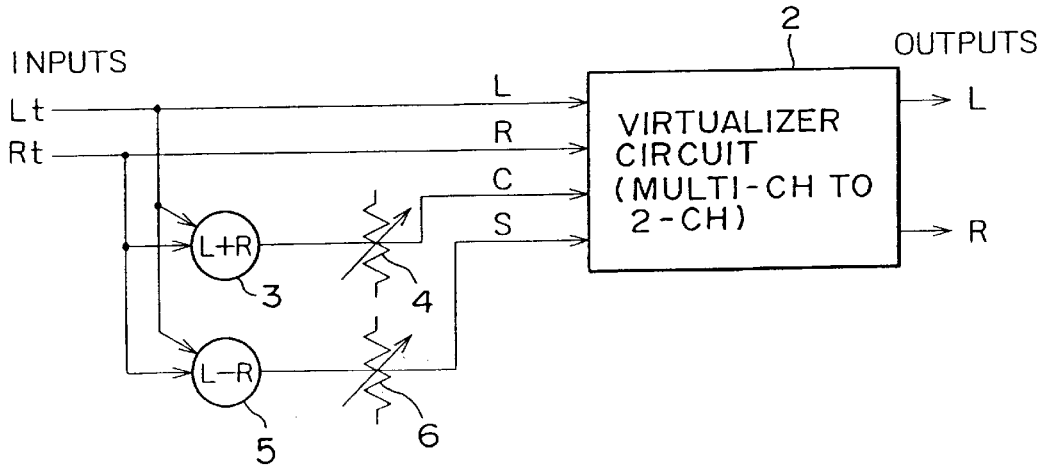
FIG. 2 is a circuit block diagram of a sound field correction circuit to which the present invention is applied.

Referring first to FIG. 2, a circuit block diagram is shown of a sound field correction circuit to which the present invention is applied. The sound field correction circuit includes a virtualizer circuit 2, an adder 3, a subtractor 5, and a pair of level adjusting volumes 4 and 6.

In the sound field correction circuit, input stereo signals Lt, Rt are first sent as L (left channel) and R (right channel) signals directly to the virtualizer circuit 2.

The input stereo signals Lt, Rt are also sent to the adder 3 and the subtractor 5. Then, the adder 3 adds the stereo signals Lt and Rt (=Lt+Rt) to produce a C (center channel) signal while the subtractor 5 calculates the difference between the stereo signals Lt and Rt (that is, Lt−Rt) to produce an S (surround channel) signal. The adder 3 and the subtractor 5 can each be readily formed from an amplification circuit which may employ, for example, an operational amplifier.

The L (left channel), R (right channel), C (center channel) and S (surround channel) signals obtained in this manner are sent to the virtualizer circuit 2 so that front 2-channel surround signals are obtained by the processing of the virtualizer circuit 2.

However, if the C (center channel) and S (surround channel) signals are supplied directly to the virtualizer circuit 2, then the input gains are fixed and the resulting sound lacks balance. In order to adjust the balance, the level adjusting volumes 4 and 6 are provided on the outputs of the adder 3 and the subtractor 5, respectively. The volume levels are adjusted relative to each other so that well-balanced easy-listening sound is obtained.

Figure 3:
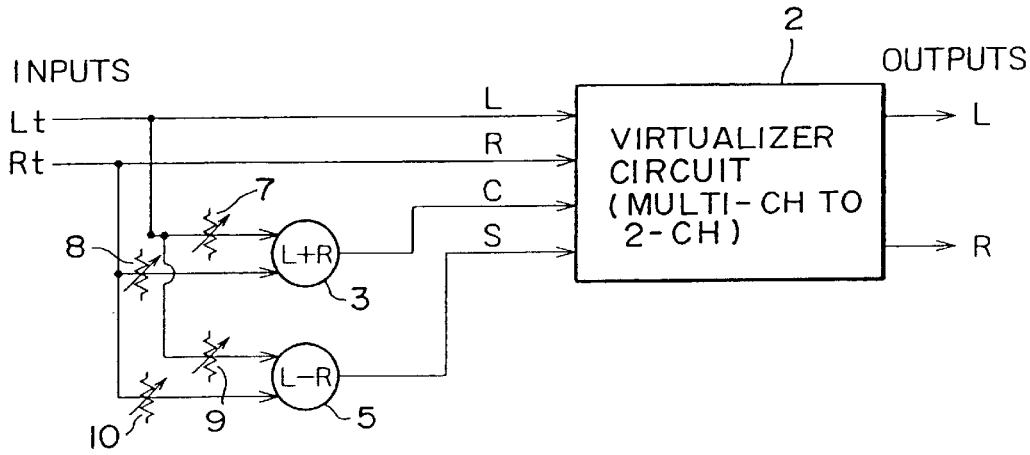
FIG. 3 is a circuit block diagram showing a modification of the sound field correction circuit shown in FIG. 2.

The sound field correction circuit described above with reference to FIG. 2 may be modified as shown in FIG. 3. In particular, referring to FIG. 3, the modified sound field correction circuit includes, instead of the level adjusting volumes 4 and 6 being connected to the output sides of the adder 3 and the subtractor 5, volumes 7 and 8 and volumes 9 and 10 are connected on the input sides of the adder 3 and the subtractor 5, respectively. The input stereo signals Lt, Rt are first adjusted by the volumes 7 and 8, respectively, and are then input to the adder 3. Meanwhile, the input stereo signals Lt, Rt are also adjusted in volume by the volumes 9 and 10, respectively, and then input to the subtractor 5. The outputs of the adder 3 and the subtractor 5 are input directly to the virtualizer circuit 2.

Figure 1:
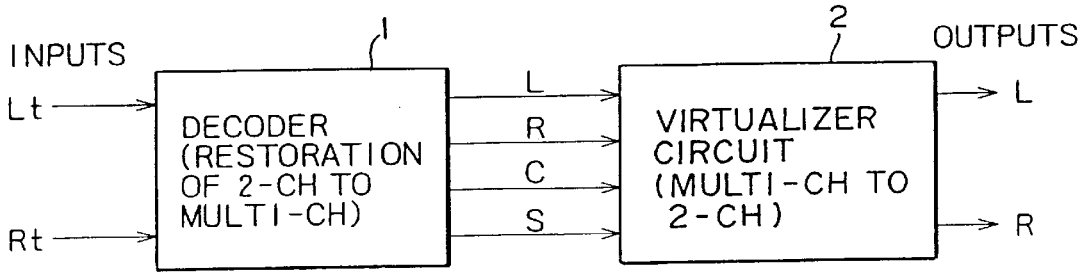
FIG. 1 is a block diagram of a sound field correction circuit which converts 2-channel signals into multi-channel surround signals and then into front 2-channel surround signals.

In the decoder 1 shown in FIG. 1, a directionality emphasis circuit formed from a plurality of delay circuits and phase-shifting circuits, a matrix circuit and so forth is incorporated so that a sufficient feeling of movement and presence can be obtained. However, since the original stereo signals have been recorded so that a feeling of movement may be provided, if the decoding circuit is simplified as in the present invention an effect proximate to the intended effect can be obtained.

Figure 4:
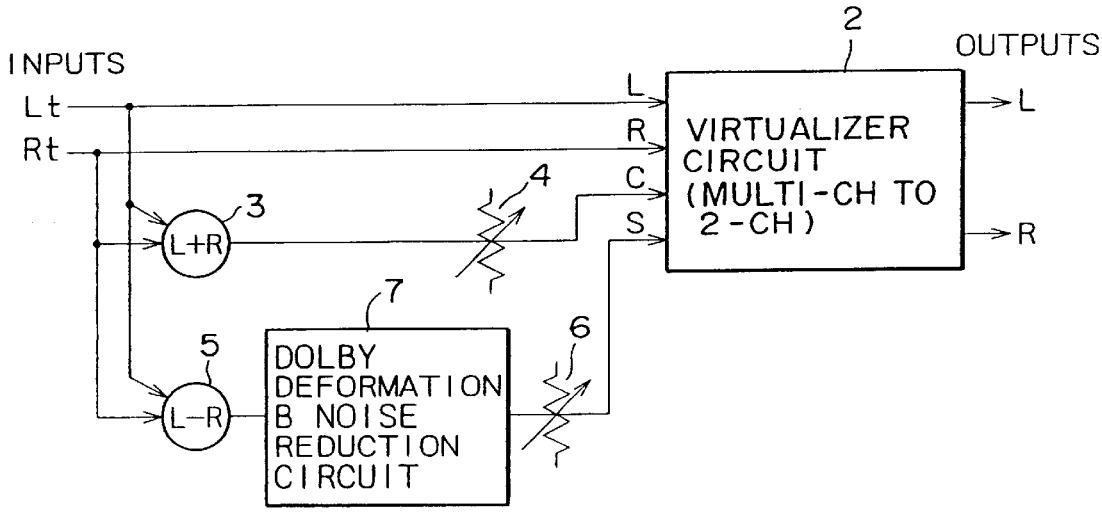
FIG. 4 is a circuit block diagram showing another sound field correction circuit to which the present invention is applied.

Referring now to FIG. 4, a circuit block diagram is shown of another sound field correction circuit to which the present invention is applied. Among the various surround systems, the Dolby surround system is presently the most popular. In the Dolby surround system, in order to improve the S/N ratio of the surround channel S, a Dolby deformation B noise reduction process is performed for the surround channel S. In this method, reduction of playback noise is performed using a method wherein the level upon recording and the level upon playback are different from each other. An equivalent process is performed in the present embodiment by a Dolby deformation B noise reduction circuit 7. When the noise reduction circuit 7 is inserted in this manner, sound with a superior S/N ratio can be reproduced.

A noise reduction circuit for noise reduction of the Dolby B type is now described briefly. The noise reduction circuit is used in a recording system for a cassette tape. The noise which is suppressed by the noise reduction circuit is limited to noise in the playback stage which is generated principally from a tape or a head, that is not noise which is present upon recording. The method of removing noise proceeds in the following manner. Prior to recording, a signal of a low level is automatically changed to a signal of a higher level so that the signal of the higher level may be recorded. Then, upon playback, the playback amplification is decreased so that the level of the changed signal is automatically returned to the original level. By this method, noise included in a signal of a low level is also decreased when played back. The Dolby B type circuit is one of the leading noise reduction circuits. Most cassette tapes on the market today are encoded with noise reduction of the Dolby B type.

Figure 5:
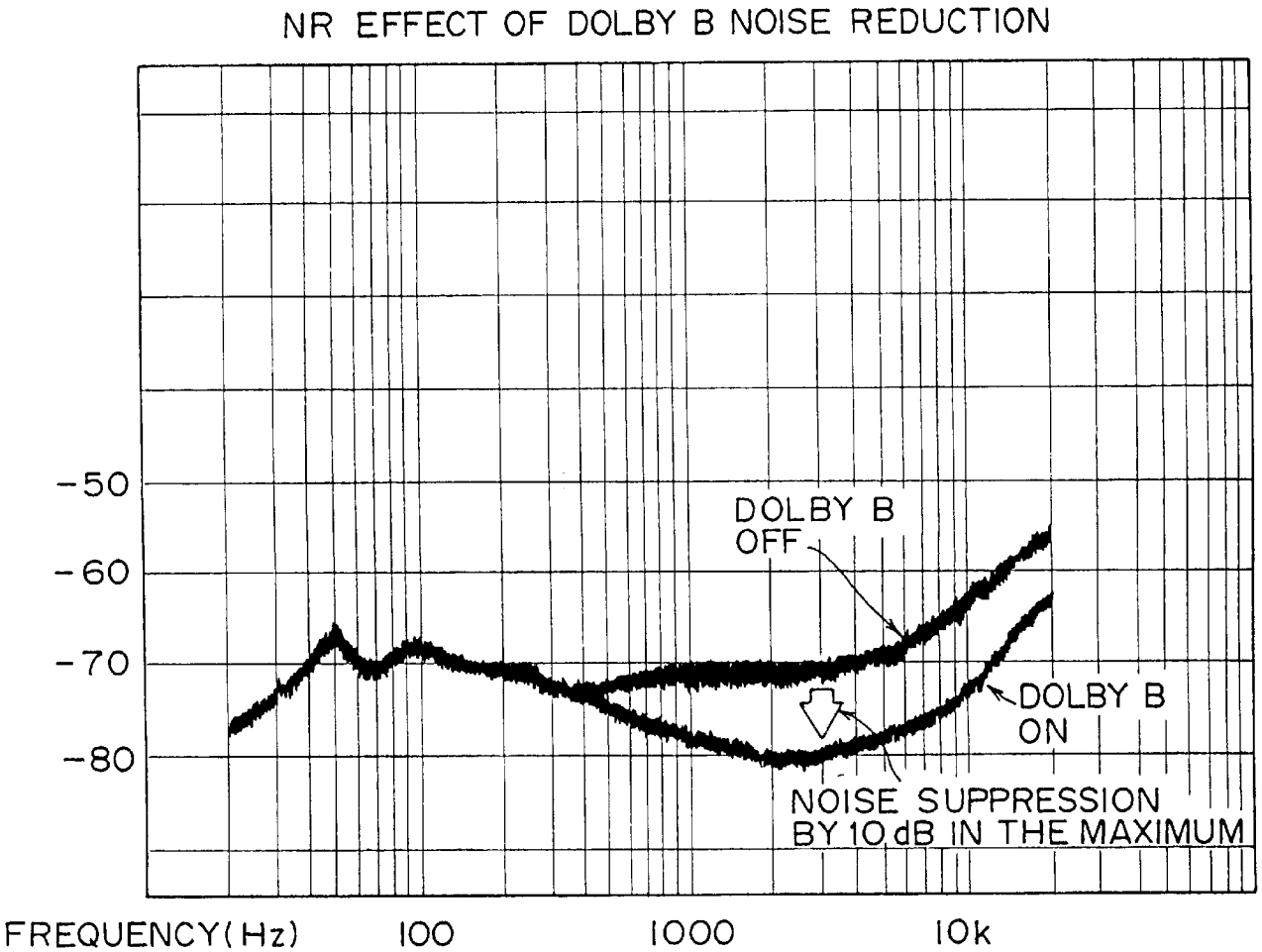
FIG. 5 is a diagram illustrating a noise suppression effect by noise reduction of the Dolby B type.

The encoding process for raising the level of a low level signal is not performed for the entire frequency band. In the Dolby B type system, encoding is performed only for frequencies higher than approximately 500 Hz, and an encoding process for raising the level prior to recording and a decoding process for lowering the level upon playback are performed at around 1 to 3 kHz, where tape noise appears in a concentrated manner. A special method, wherein the frequency band for the process is varied depending upon the signal level, is sometimes employed. The noise suppression capacity of the Dolby B type noise reduction is 10 db maximum, as seen from FIG. 5.

Another characteristic of the Dolby B type noise reduction resides in that the reduction is achieved not by changing the amplification degree of the entire amplifier, but by extracting signal components which are included in a band to be processed. The signal components are successively increased as the level drops with respect to a boundary level called the Dolby level. The signal components are added to the original signal to intensify the original signal. Upon playback, both the signal components and noise are extracted from the playback signal. As the signal level approaches the Dolby level, the level variation amount decreases and the noise suppression amount correspondingly decreases. Where the signal level is high, there is no real signal loss due to a masking effect and because the entire processing amount is small. This masking effect occurs because the gain variation of an amplifier cannot follow a sound which exhibits a quick rise and a short duration.

In order to extract the signal components in the band to be processed while successively increasing these components, a unique method is adopted. A single circuit for determining such components to be extracted is provided for both recording and playback. Consequently, the components to be extracted, that is the signal components to be added and subtracted, are the same and the reproduction quality of the playback signal with respect to the original signal is very high.

As described in the description of the related art hereinabove, to obtain front 2-channel surround signals from multi-channel surround signals, a decoder which employs an expensive matrix circuit (such as a Dolby pro-logic circuit) is used in order to achieve a sufficient effect.

While preferred embodiments of the present invention have been described using specific terms, such description is for illustrative purposes only, and it is to be understood that changes and variations may be made without departing from the spirit or scope of the following claims.

What we claim is:

1. A sound field correction circuit which receives signals of at least 2 channels encoded for a multi-channel surround effect as input signals and outputs multi-channel surround signals, consisting of:

inputting means for receiving a first signal and a second signal encoded for a multi-channel surround effect as input signals;

decoding means for decoding the first and second signals to produce multi-channel surround signals; said decoding means including a first level adjustment means for adjusting the first signal and outputting a first adjusted first signal; a second level adjustment means for adjusting the second signal and outputting a first adjusted second signal; a third level adjustment means for adjusting the first signal and outputting a second adjusted first signal; and a fourth level adjustment means for adjusting the second signal and outputting a second adjusted second signal; an adder for adding the first adjusted first signal and first adjusted second signal to produce a sum signal; and a subtractor for subtracting the second adjusted first signal and second adjusted second signal to produce a difference signal; and a virtualizer for receiving the first signal, the second signal, the sum signal and the difference signal and outputting a desired number of channels of surround signals; whereby the sound field correction circuit is a simple and low-cost circuit for producing multi-channel surround signals.

2. A sound field correction method wherein signals of at least 2 channels encoded for a multi-channel surround effect are received as input signals and multi-channel surround signals are outputted, consisting of:

an inputting step of receiving a first signal and a second signal encoded for a multi-channel surround effect as input signals;

a decoding step of decoding the first and second signals to produce multi-channel surround signals; the decoding step including a first level adjustment step of adjusting the first signal and outputting a first adjusted first signal; a second level adjustment step of adjusting the second signal and outputting a first adjusted second signal; a third level adjustment step of adjusting the first signal and outputting a second adjusted first signal; and a fourth level adjustment step of adjusting the second signal and outputting a second adjusted second signal; an addition step of adding the first adjusted first signal and first adjusted second signal to produce a sum signal; and a subtraction step of subtracting the second adjusted first signal and second adjusted second signal to produce a difference signal; and a virtualizing step of receiving the first signal, the second signal, the sum signal and the difference signal and outputting a desired number of channels of surround signals; whereby the sound field correction method is a simple and low-cost method of producing multi-channel surround signals.

* * * * *